United States Patent [19]

Barnett

[11] 4,241,718

[45] Dec. 30, 1980

[54] RANGE BODY COOLING SYSTEM

[75] Inventor: Eugene J. Barnett, Mansfield, Ohio

[73] Assignee: White Consolidated Industries, Inc., Cleveland, Ohio

[21] Appl. No.: 892,846

[22] Filed: Apr. 3, 1978

[51] Int. Cl.[3] ..... F24C 15/32

[52] U.S. Cl. ..... 126/21 R; 126/19 R

[58] Field of Search ..... 126/21 R, 21 A, 273 R

[56] References Cited

U.S. PATENT DOCUMENTS

| | | | |
|---|---|---|---|
| 2,526,890 | 10/1950 | Mendel | 126/21 R |
| 3,081,763 | 3/1963 | Newell | 126/21 R |
| 3,480,000 | 11/1969 | Torrey | 126/21 A |
| 3,499,430 | 3/1960 | Kemp | 126/21 R |
| 3,548,152 | 3/1969 | Klepzig | 126/21 X |
| 3,587,557 | 9/1969 | Henderson et al. | 126/21 A |
| 3,659,578 | 12/1970 | Davis et al. | 126/21 R |
| 4,021,642 | 2/1975 | Fields, Jr. | 126/21 R X |

*Primary Examiner*—Samuel Scott
*Assistant Examiner*—G. Anderson
*Attorney, Agent, or Firm*—Pearne, Gordon, Sessions, McCoy & Granger

[57] ABSTRACT

A free-standing, convection-cooled domestic range of the pyrolytic self-cleaning type including heat sink means for limiting the temperature of user accessible exterior surfaces of the range body to safe levels during a high temperature, oven-cleaning operation. A pair of downwardly extending, elongated channel members having U-shaped cross sections is positioned within the range body, one under each upper front corner thereof between a respective side wall of the range body and an opposed oven liner side wall. Apertured, horizontal mounting flanges from which the channel members are hung advantageously allow for the unimpeded upward flow of convected air along the entire lengths of the heat sink channel members.

3 Claims, 6 Drawing Figures

RANGE BODY COOLING SYSTEM

BACKGROUND OF THE INVENTION

The present invention relates in general to convection-cooled domestic ranges, and more particularly to means for controlling the temperature of user accessible range body surfaces during a pyrolytic, oven-cleaning operation.

Prior art domestic ranges of the pyrolytic self-cleaning type have, for the most part, relied upon forced air cooling systems for limiting exterior range cabinet surface temperatures to the generally accepted safety standard of 55 degrees Celsius or less during a high temperature oven-cleaning operation wherein oven liner temperature often exceeds 400 degrees Celsius.

It has been recognized that the use of a convection cooling system is preferable to a forced air system from both a cost and reliability standpoint.

The successful adaptation of a convection cooling system to a pyrolytic self-cleaning type range requires that particular attention be paid to cooling air distribution relative to thermal accumulation at specific range body locations. The entrapment of highly heated air within the range body must be avoided to preclude hazardous hot spots on its exterior surfaces. Further, where thermal accumulation at particular range body locations cannot be controlled by air flow alone, such convection air flow rate having practical limits, supplemental means must be provided to achieve temperature regulation.

The present invention solves and fulfills the heretofore noted problems and requirements in an efficient manner.

SUMMARY OF THE INVENTION

In accordance with the present invention, an exterior range body housing, having vertical front, rear, and opposite side walls, a horizontal platform supported on said walls, and a boxlike oven liner contained therein and spaced from said side walls and said platform, is provided with heat sink means mounted within the range body housing between the housing side walls and opposed oven liner side walls, the heat sink means being generally adjacent the front wall and the platform. The heat sink means serve to regulate the heating of the exterior upper front corners of the range body when the oven liner is heated to a high temperature to effect pyrolytic cleaning action.

Cooling air provided by an air inlet, located in a portion of the housing front wall generally below the oven liner, is heated by contact with the highly heated oven liner walls and convects upwardly to contact the heat sink means where a portion of its heat is given up prior to contacting the upper front corners of the platform. The convected air moves out of contact with the heat sink means and is exhausted at an outlet, located in a portion of the housing back wall higher than the heat sink means.

The heat sink means in the form of a pair of elongated channel members are each hung from an apertured portion of a horizontal mounting flange, such apertured portion preventing the undesirable entrapment of convected air, thus facilitating air movement past the heat sink channel members.

DETAILED DESCRIPTION OF THE PREFERRED EMBODIMENT

Figure 1:
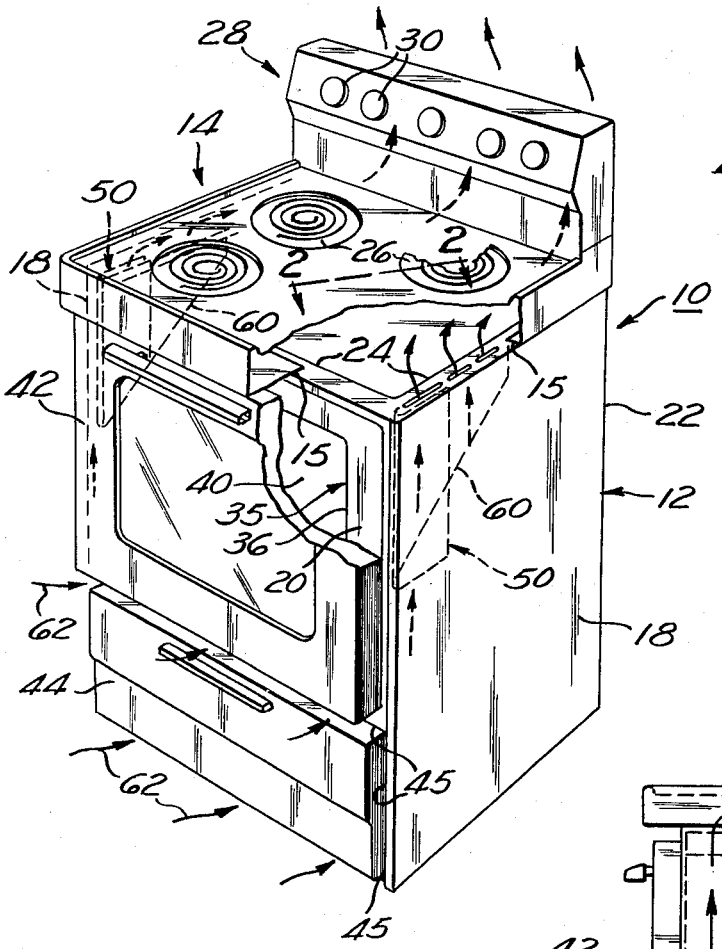
FIG. 1 is a perspective view, with portions cut away, of a free-standing, convection-cooled, domestic range in accordance with the present invention.

Turning to FIG. 1, a convection-cooled range body 10 includes a range body housing 12 supporting a horizontally oriented range platform 14. The housing 12 and platform 14 are formed in a conventional manner from enameled or painted sheet metal. The range body housing 12 includes exterior, vertically extending housing side walls 18, a vertically extending housing front wall 20, and a vertically extending housing rear wall 22 which may be formed of a plurality of removable partitions to permit access to the interior of the range body 10 for maintenance purposes.

The upper ends of the side walls 18 and the front wall 20 include an inwardly extending, perimetric, horizontal flange 24 which provides structural rigidity to the housing walls and further serves as a support surface for an abutting perimetric edge 15 of the range platform 14.

The range platform 14 includes four conventional electric element burners 26, only three of which are illustrated. A rearward portion of the platform includes an elevated control housing 28, which contains, for example, rotary control switches 30 providing electrical energy to respective burners 26 and other range circuitry.

A boxlike, five-sided oven liner 35, spaced from the side walls 18 (FIGS. 1, 3), defines an oven cavity 40 accessible through the housing front wall 20. Access to the oven cavity 40 is controlled by a conventional, movable oven door 42 which abuts the front wall 20 in a generally airtight sealing arrangement, as is the practice in the art of high temperature, pyrolytic cleaning ovens.

The lower portion of the range body housing 12 includes a movable cooking utensil drawer 45 which loosely fits in a non-airtight relationship within the lower portion of the range body housing 12 via the front wall 20. The loose-fitting drawer 45 permits air to enter into the lower portion of the range body housing, as illustrated.

The elements of the range body 10 described thus far are conventional and known in the art. Provided within the range body housing 12, adjacent the front wall 20 and the platform 14, are heat sink means in the form of a pair of elongated channel members 50. The channel members 50 are each hung between the side walls 18 and opposed oven liner side walls 36 from a portion of the support flange 24 containing apertures 52. Conventional triangular heat baffle plates 60 are located between the oven liner side walls 36 and the heat sink channel members 50.

Figure 2:
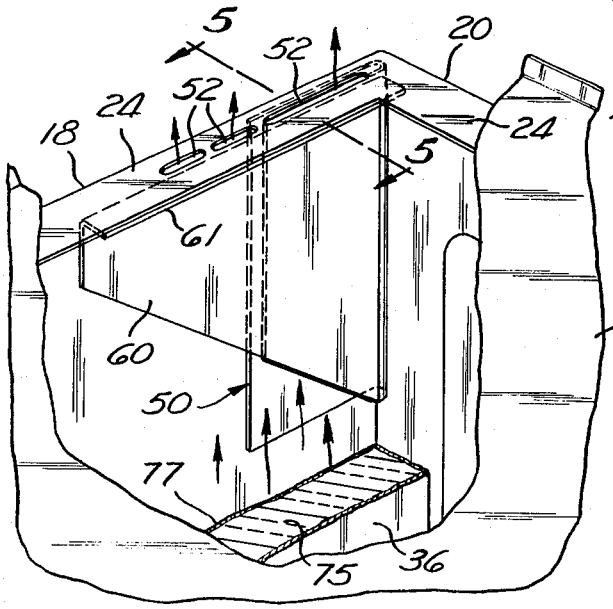
FIG. 2 is a perspective view along line 2—2 of FIG. 1, with a portion of the oven liner removed to show a heat sink member hung from an apertured portion of a mounting flange.
Figure 3:
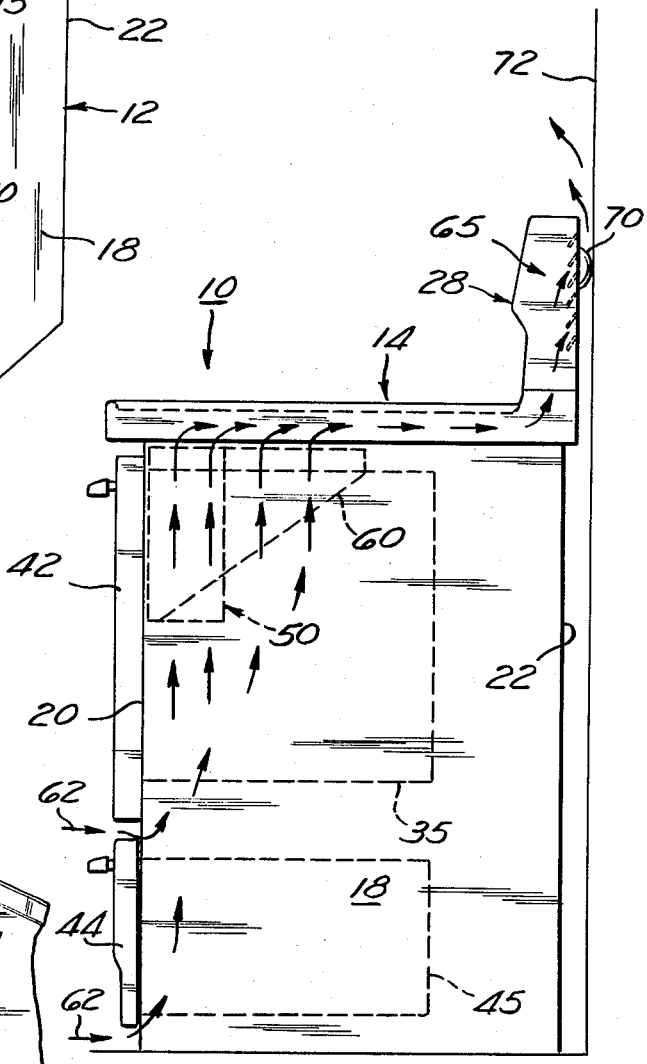
FIG. 3 is a side elevational view of FIG. 1, illustrating convected, cooling air flow in accordance with the invention.
Figure 6:
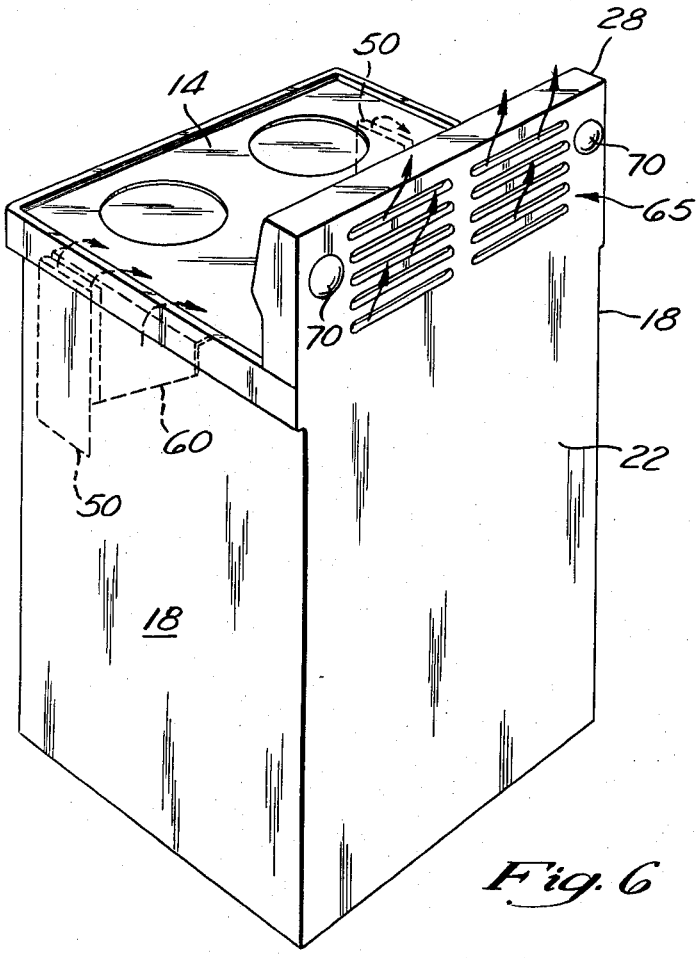
FIG. 6 is a rear, perspective view of the range illustrated in FIG. 1.

Referring to FIGS. 1 and 2, it can be seen that cooling air 62 is provided via a downstream point air inlet means, below the heat sink channel members 50, in the lower portion of the range body housing 12, the inlet means being constituted by the non-airtight mating periphery 45 of the loose-fitting, cooking utensil drawer 44 extending through the front wall 20 into the interior of the housing 12. Once within the body 10, the cooling air begins to heat and convect upwardly between the oven liner side walls 36 and the housing side walls 18. At least a portion of the upwardly moving, convected air contacts the heat sink channel members 50 and gives off a portion of its heat. The air then passes out of contact with the heat sink channel members 50, moves up under the platform 14, and moves rearwardly towards the control housing 28, wherein it is exhausted at an upstream point air outlet means, above the heat sink channel members 50, constituted by an upper, apertured, gratelike portion 65 of the housing back wall 22. To ensure that the gratelike portion 65 is not blocked, mechanical offset means, in the form of a pair of protruding dimples 70 adjacent the gratelike portion 65, are provided (FIGS. 3, 6). The protruding dimples 70 serve to offset the gratelike back wall exhaust or gratelike portion 65 from an adjacent wall structure 72 (FIG. 3).

The heat sink channel member 50 serves to absorb and transfer heat during the initial period of a self-cleaning operation so that the upper front corners of the range body 10 do not absorb excessive heat. The apertures 52 serve to provide an unimpeded path for the upward flow of convected air, and further serve to avoid the entrapment of heated air.

With particular reference to FIG. 2, the side walls of the oven liner 35 are encased in appropriate thermal insulation 75, which in turn is compressed against the oven liner side walls 36 by an insulation-retaining wall 77. The insulated oven liner 35 is well known in the art, and is mounted against the housing front wall and spaced from the side walls 18 of the range housing 12. Hung from the mounting flange 24 is the conventional heat baffle plate 60. Positioned between the heat baffle plate 60 and the side wall 18, in accordance with the present invention, is the vertically extending heat sink channel member 50, which has a U-shaped horizontal plane cross section, the U-shape opening towards the rear wall 22 of the range body housing 12. Such a heat sink member provides a large surface area for the conduction of heat from the upwardly moving, convected air. At the termination of the pyrolytic cleaning operation, the large surface of the heat sink gives off, at a controlled rate, the heat that it earlier had absorbed from the heated air. Thus, the heat sink serves to advantageously stabilize the heating of the adjacent upper front corners of the platform.

Figure 4:
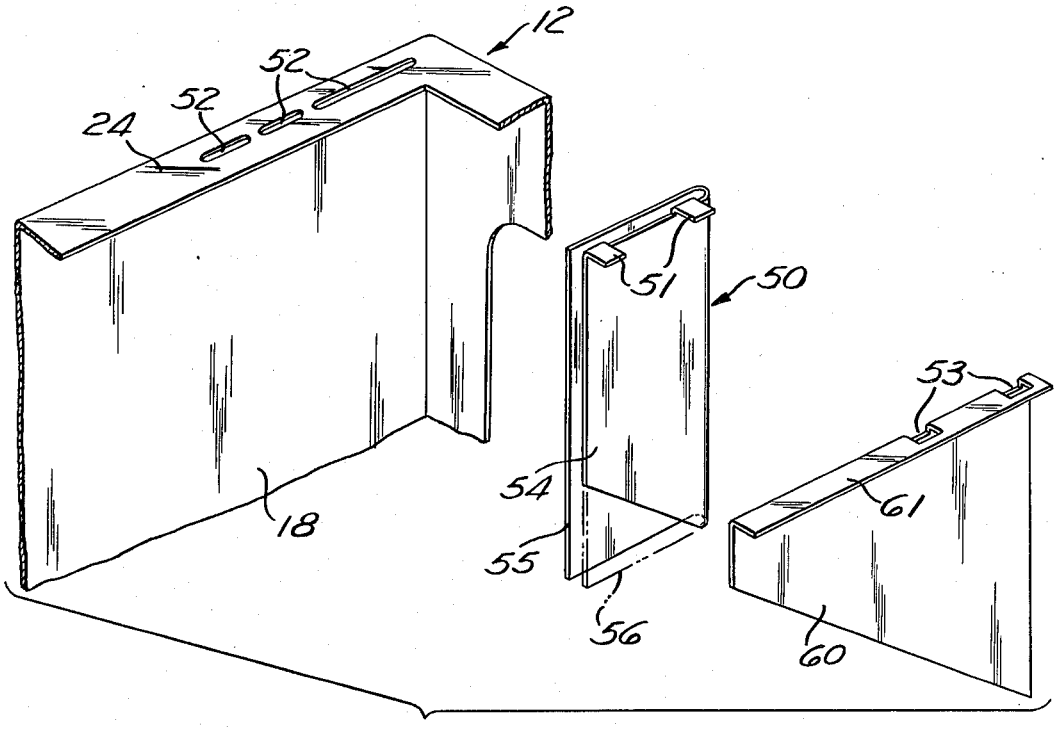
FIG. 4 illustrates a heat sink member in disassembled relationship relative to a heat baffle plate and a range housing side wall.

Turning to FIG. 4, the elongated heat sink channel member 50 can be seen prior to its assembly within the range housing 12. Mounting tabs 51 extend horizontally from the upper end of the heat sink channel member 50 and mate with corresponding, horizontal slots 53 on an upper horizontal flange portion 61 of the heat baffle plate 60. Final assembly of the conventional heat baffle plates 60, the heat sink channel members 50, and the portions of the mounting flange 24 containing apertures 52 is provided by suitable fastening means (not shown) in the form of conventional welds, sheet metal screws, or the like.

Figure 5:
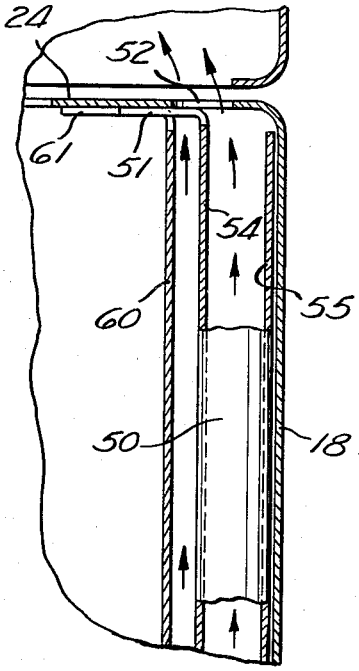
FIG. 5 is an elevational view along line 5—5 of FIG. 2, illustrating the spacing of a heat sink between the housing side wall and an oven liner baffle plate.

The spatial relationship of the heat sink channel member 50 relative to its associated heat baffle plate 60 and side wall 18 is illustrated in FIG. 5. An innermost leg 54 of the heat sink channel member 50 is spaced from the heat sink baffle 60, as illustrated. An outer heat sink leg 55 is spaced from the side wall 18. The legs 54, 55 are geometrically identical to each other but for the removal of triangular portion 56 from the lower end of leg 54, the removal of such a portion being necessary to accommodate a mounting plate structure (not shown) to which the lower portion of the oven door 42 (FIG. 1) is hinged. It should be noted that the outermost leg 55 could abut the sidewall 18 in a heat conduction relationship without departing from the scope of the present invention. It can be seen that convected air flows upward and contacts the heat sink member prior to its being exhausted at an upstream point via the apertures 52. Such a structure advantageously provides controlled heating and cooling of the upper front corners of the range body 12 during a pyrolytic cleaning operation.

While a preferred embodiment of the invention has been disclosed, it is to be understood that various modifications and rearrangements of parts may be resorted to without departing from the scope of the invention.

What is claimed is:

1. A free-standing convection-cooled domestic range of the pyrolytic self-cleaning type comprising:

an exterior housing having vertically extending front, rear, and opposite side walls;

a horizntal platform supported by at least said side walls, said platform having a perimetric edge adjacent the upper edges of at least said front and side walls;

a boxlike oven liner disposed within said housing walls and below said platform, said liner defining an oven cavity opening through an access aperture in said front wall, said liner being spaced from at least said side walls and said platform;

movable door means for closing access to said oven cavity;

heat sink means disposed between said side walls and said oven liner, said heat sink means being located generally adjacent said front wall and said platform, said heat sink means including a vertically extending, elongated, metallic channel member having a U-shaped horizontal plane cross section, said U-shaped cross section opening toward said rear wall and being defined in part by a pair of leg members spaced from each other, air inlet means in said front wall, said air inlet means being disposed below said heat sink means at a downstream point, wherein air provided via said inlet means, when heated, moves upward by convection and contacts said heat sink means, said provided air moving out of contact with said heat sink means and being exhausted at a point above said heat sink means at an upstream point, and flange means extending inwardly toward said liner, from the upper end of said side walls at least a portion of each of said flanges being disposed above said heat sink means and below said platform, said flange portion including apertures for passing at least a portion of said provided air from said heat sink means location to said outlet means, said portion of said provided air carrying heat from said heat sink means upwardly through the space between said pair of legs of said channel member and then through said apertures.

2. A range according to claim 1, wherein said outlet means is an apertured location in an upper portion of said back wall.

3. A range according to claim 2, wherein said back wall includes means for spacing said apertured location from adjacent structures.

* * * * *